US006282401B1

(12) United States Patent
Proulx et al.

(10) Patent No.: US 6,282,401 B1
(45) **Date of Patent: *Aug. 28, 2001**

(54) HARD CLEANING BLADE FOR CLEANING AN IMAGING MEMBER

(75) Inventors: Rodney B. Proulx, Webster; Nero R. Lindblad, Ontario; Leroy M. Nye, Penfield, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/389,109

(22) Filed: Sep. 2, 1999

(51) Int. Cl.[7] ..... G03G 21/00
(52) U.S. Cl. ..... 399/350
(58) Field of Search ..... 399/350, 343, 399/351; 15/256.5

(56) References Cited

U.S. PATENT DOCUMENTS

| | | | | |
|---|---|---|---|---|
| 4,264,191 | * | 4/1981 | Gerbasi et al. | 399/350 X |
| 4,989,047 | | 1/1991 | Jugle et al. . | |
| 5,031,000 | | 7/1991 | Pozniakas et al. . | |
| 5,122,839 | * | 6/1992 | Siegel et al. | 399/350 X |
| 5,157,098 | | 10/1992 | Lindblad et al. . | |
| 5,339,149 | * | 8/1994 | Lindblad et al. | 399/351 |
| 5,349,428 | | 9/1994 | Derrick . | |
| 5,357,320 | * | 10/1994 | Kashimura et al. . | |
| 5,416,572 | | 5/1995 | Kolb et al. . | |
| 5,450,184 | | 9/1995 | Yanai et al. . | |
| 5,596,398 | * | 1/1997 | Woo et al. | 399/350 X |
| 5,732,320 | | 3/1998 | Domagall et al. | 399/350 |
| 6,088,565 | * | 7/2000 | Jia et al. . | |

FOREIGN PATENT DOCUMENTS

| | | |
|---|---|---|
| 62134678 | 6/1987 | (JP) . |
| 02284191 | 11/1990 | (JP) . |
| 04226308 | 8/1992 | (JP) . |
| 05127575 | 5/1993 | (JP) . |
| 05150697 | 6/1993 | (JP) . |

* cited by examiner

*Primary Examiner*—Susan S. Y. Lee
(74) *Attorney, Agent, or Firm*—Annette L. Bade

(57) ABSTRACT

A relatively hard cleaning blade for use in a cleaning apparatus in an imaging apparatus for cleaning residual toner particles, including dry and liquid ink toners and carriers, from an imaging surface, the cleaning blade having a material having a hardness of from about 86 to about 120 Shore A.

24 Claims, 6 Drawing Sheets

HARD CLEANING BLADE FOR CLEANING AN IMAGING MEMBER

BACKGROUND OF THE INVENTION

The present invention relates to a blade material useful in an electrophotographic printing apparatus, including image on image, contact electrostatic printing, and digital apparatuses. Specifically, the present invention relates to a blade material useful in a cleaning blade, in particular a blade for cleaning an imaging member, used therein to remove particles, especially non-agglomerated particles, adhering to the charge-retentive, image bearing or photoconductive surface.

In the process of electrophotographic printing, an imaging surface is charged to a substantially uniform potential. The imaging surface is imagewise exposed to record an electrostatic latent image corresponding to the informational areas of an original document being reproduced. This records an electrostatic latent image on the imaging surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the imaging surface to a sheet of support material and permanently affixed thereto. In a manner similar to the aforementioned dry toner imaging, liquid toner-based electrophotographic printing produces visible images from latent electrostatic images that are then transferred and fixed. In a unique liquid toner-based printing technology referred to as Contact Electrostatic Printing, the image is formed by selective "transfer" while in direct contact between imaging surface and image bearing surface. The imaging surface can be a photoreceptor or dielectric, and the image-bearing member is a compliant member, similar to an offset press blanket.

In a reproduction process of the types as described above, it is inevitable that some residual toner will remain on the imaging surface or image bearing surface after the toner image has been transferred to the sheet of support material (e.g., paper). It has been found that with such a process, the forces holding some of the toner particles to the imaging surface are stronger than the transfer forces, and therefore, some of the particles remain on the surface after transfer of the toner image. In the process of Contact Electrostatic Printing (CEP), the development step produces a residual layer of liquid developer that is the "negative" of the image area. Typically, the CEP development process produces a residual image with greater mass than the imaged area. The residual must be removed from the imaging surface and reclaimed after each revolution. The residual material removed per unit time is much greater in the case of CEP than conventional dry toner development processes. In addition to the residual toner, other particles, such as paper debris (i.e. Kaolin, fibers, clay), additives and plastic, are left behind on the surface after image transfer, or development in the case of CEP. These residual particles are different from agglomerated particles in that they are not groups of particles that have built up over time. Hereinafter, the term "residual particles" encompasses residual toner and other residual particles remaining after image transfer. The residual particles adhere firmly to the surface and must be removed prior to the next printing cycle to avoid interfering with recording a new latent image thereon.

Various methods and apparatuses may be used for removing residual particles from the imaging surface.

Hereinbefore, a cleaning brush, a cleaning web, and a cleaning blade have been used. Both cleaning brushes and cleaning webs operate by wiping the surface so as to affect transfer of the residual particles from the imaging surface.

In addition to forming residual particles, dry toner particles agglomerate with themselves and with certain types of debris such as paper fibers, dirt and the like, thereby forming spot-wise depositions that eventually strongly adhere to the image bearing member. These spot depositions range from 50 micrometers to greater than 400 micrometers in diameter, but typically are about 200 to about 250 micrometers in diameter, and 5 to 25 micrometers in thickness, but typically about 5 to 15 micrometers in thickness. The agglomerates range in material compositions from toner by itself to a broad assortment of plastics and debris from paper. The spots may appear at random positions on the surface of the image-bearing member. Because the spot material is charged when passing under the charge corotron, the toner is subsequently developed on it. When the image is developed and subsequently transferred to a copy substrate, the toner on the spot is also transferred to the copy substrate. Accordingly, the spots cause a copy quality defect showing up as a black spot on a background area of the copy, which is the same size as the spot on the image-bearing member. The spot on the copy varies slightly with the exact machine and the specific operating conditions, but cannot be deleted by controlling the machine process controls.

For removing residual particles for both liquid and dry image forming processes, a relatively "soft" cleaning blade has been used in the past. Such a "soft" blade was necessary in order for the blade to uniformly tuck for efficient cleaning. The force required to cause the blade to tuck uniformly is the minimum cleaning force. Soft cleaning blades are made from a soft polyester urethane material having a hardness of from about 60 to about 80 Shore A, and on average have a hardness of about 70 Shore A. Also, the soft materials have a very "high" coefficient of friction. The high coefficient of friction usually ranges from about 25 to about 200 when measured at about 30±5 RH (percent relative humidity) and 72±2° F. The high friction can cause the blade to tuck severely when the blade contacts a clean portion of the imaging member. This, in turn, causes a random failure mode. This severe tucking stresses the cleaning edge and creates stress fractures. The stress fractures eventually develop into craters. These craters increase in size as use of the blade continues, and an increase in the occurrence of nicks in the cleaning edge occurs. Field studies determined that stress fractures, craters, and nicks accounted for about 80 percent of the blade failures for one Xerox machine.

Efforts at improving the cleaning efficiency of a soft cleaning blade in the dry toner process, include providing lubrication to aid in decreasing the friction of the blade. Also, with "soft" cleaning blades, blade squeal occurs when the lubrication level is low, especially at high temperatures of about 80° F. Blade squeal creates a high pitch noise from the machine that annoys users and people working in the office environment. This is primarily a concern on copier/printers, which use drums as image bearing members. There are several methods that can be employed to reduce the blade squeal. Damping features can be attached to the image-bearing member drum cavity, and the blade thickness and extension can be adjusted to reduce the noise. The noise is caused by the high frequency vibration of the cleaning edge on the imaging surface and occurs when the friction is too low. Another problem associated with "soft" blades is that the blade tends to stick-slip on the imaging surface in the absence of lubrication, thereby severely stressing the cleaning edge and causing the blade to miss residual particles to be cleaned. In a liquid system, the blade is immersed in liquid carrier that provides the lubrication. The stick-slip phenomena apply mainly to dry toner imaging.

Turning to a spots blade useful in removing agglomerated particles formed in the dry process, several copier products commonly use a "hard" urethane blade material (supplied by Acushnet and Zatec) as a spots blade. The spots blade is positioned, after or downstream from the cleaning station, to remove agglomerates and debris from the image-bearing member. The purpose of the spots blade is not for removing toner, but for removing agglomerated spots. Therefore, the set up parameters for the spots blade (for example, the blade load and angles) are different from a standard cleaning blade. As set forth above, with the standard "soft" cleaning blade, the blade force and angles are set so that the cleaning edge slides on the image-bearing member to clean toner, and this set-up results in the cleaning edge sliding in a tuck configuration. Alternatively, for the spots blade, the load and angles are set so that the blade does not tuck, but slides on the image-bearing member and "bumps" or "knocks" the spots off the image bearing member. Therefore, spots blades are made of "hard" materials such as polyurethanes having a hardness of from about 80 to about 95 Shore A. Preferred spots blades are positioned at a low angle of attack in engagement with the charge retentive surface.

U.S. Pat. No. 5,339,149 discloses a spots blade made of a polyester urethane having a low coefficient of friction, low resilience, and a hardness of from about 80 Shore A to about 90 Shore A.

U.S. Pat. No. 5,416,572 discloses a spots blade made of a polyurethane material having a hardness of 80 Shore A.

U.S. Pat. No. 5,349,428 discloses a spots blade positioned at a low angle of attack relative to the photoreceptor to minimize tuck occurrence. The spots blade is made of a polyurethane material having a hardness of 80 Shore A.

U.S. Pat. No. 4,989,047 discloses a polyurethane spots blade material having a hardness of 70 Shore A. A relatively low load is applied to the blade and it is positioned at a low angle of attack relative to the photoreceptor.

U.S. Pat. No. 5,031,000 discloses a polyurethane spots blade material having a hardness of 70 Shore A. The blade is supported in a floating support assembly to prevent tuck-under and damage to the blade.

U.S. Pat. No. 5,732,320 discloses a relatively hard spots blade made of polyether urethane, and in preferred embodiments, having a hardness of from about 86 to about 100 Shore A.

Therefore, relatively "soft" blades have been used to clean residual toner particles, and relatively "hard" blades have been used as spots blades for cleaning agglomerated toner from an imaging surface.

It is desirable to provide a cleaning blade for cleaning the imaging member, which has the superior properties of both "hard" and "soft" blades, and which dispenses with the need for both a cleaner and a spots blade. It is desirable to provide a cleaning blade with increased cleaning efficiency without the need for lubricants. It is also desirable to provide a cleaning blade that does not exhibit stick-slip motion on the imaging surface, thereby stressing the cleaning edge, and missing residual particles to be cleaned. Moreover, it is desirable to provide a cleaning blade that is tough and has increased strength, and is therefore less resistant to tearing. These factors give the blade very high reliability. The desirable overall qualities are excellent cleaning, and high reliability for cleaning dry toners and liquid inks.

BRIEF DESCRIPTION OF THE FIGURES

Other features of the present invention will become apparent from the following description and upon reference to the drawings, in which.

SUMMARY OF THE INVENTION

Embodiments of the present invention include: a cleaning apparatus for cleaning materials from an imaging surface comprising: a hard cleaning blade for cleaning residual particles from the imaging surface, the hard cleaning blade having an end being in pressure contact and in continuous slidable contact with the imaging surface, wherein the cleaning blade comprises a material having a hardness of from about 86 to about 120 Shore A.

Embodiments further include: a cleaning apparatus for cleaning materials from an imaging surface comprising: a hard cleaning blade for cleaning residual particles from the imaging surface, the hard cleaning blade having an end being in pressure contact and in continuous slidable contact with the imaging surface, wherein the cleaning blade comprises polyurethane having a hardness of from about 94 to about 95 Shore A, and a coefficient of friction of less than about 10.

Embodiments also include: an image forming apparatus for forming images on a recording medium comprising: a) a charge-retentive surface to receive an electrostatic latent image thereon; b) a development component to apply toner to the charge-retentive surface to develop the electrostatic latent image to form a developed image on the charge retentive surface; c) a transfer component to transfer the developed image from the charge retentive surface to a copy substrate; and d) a cleaning apparatus for cleaning materials from an imaging surface comprising: a hard cleaning blade for cleaning residual particles from the imaging surface, the hard cleaning blade having an end being in pressure contact and in continuous slidable contact with the imaging surface, wherein said cleaning blade comprises a material having a hardness of from about 86 to about 120 Shore A.

DETAILED DESCRIPTION OF THE INVENTION

Figure 1:
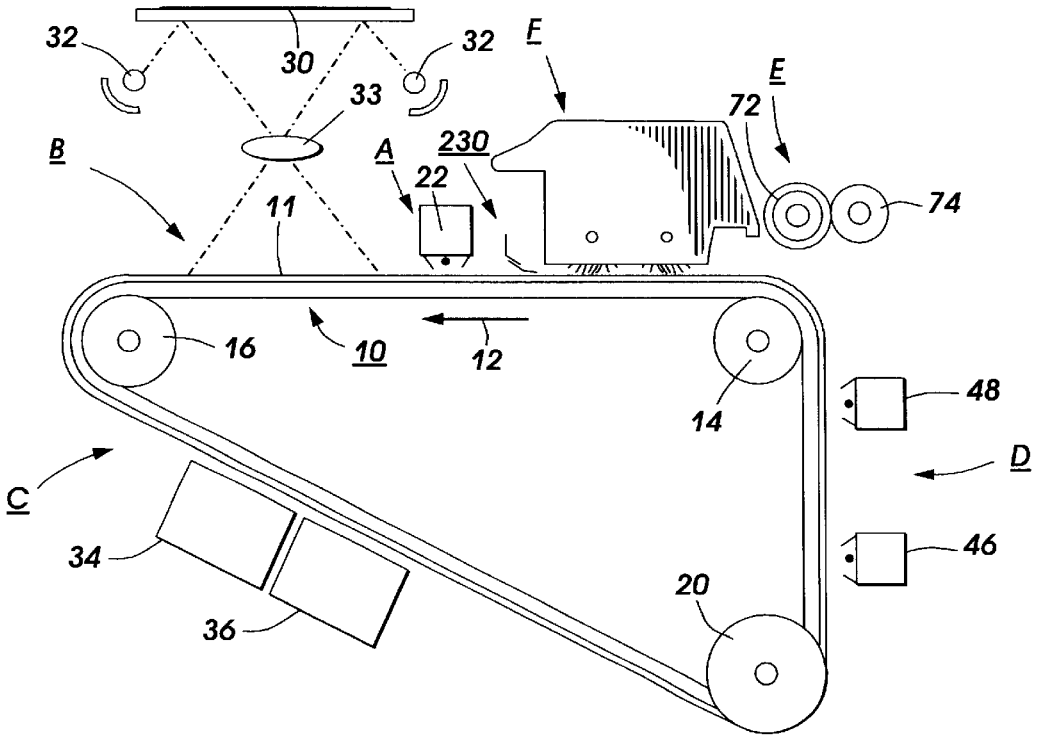
FIG. 1 PRIOR ART
FIG. 1 a schematic elevational view of a printing apparatus.

For a general understanding of an electrophotographic printer or copier in which the present invention may be incorporated, reference is made to FIG. 1 which depicts schematically various components thereof in an embodiment of the present invention. Although the cleaning blade of the present invention is equally suitable for use in a printer or copier, it should become evident from the following discussion that the cleaning blade disclosed herein is equally well suited for use in other applications and is not necessarily limited to the particular embodiments shown herein.

An embodiment of a reproducing machine, in which the present invention may be used, has a image-bearing member 10, having a photoconductive, charge-retentive or imaging surface 11. The image-bearing member moves in the direction of arrow 12 to advance to various stations. Rollers 14, 16 and 20 move the belt 10.

The belt passes through charging station A where it receives a substantially uniform potential charge from corona device 22. At exposure station B, an original document is positioned face down on transparent platen 30 for illumination with flash lamps 32. Light rays reflected from the original document are reflected through a lens 33 and projected onto the charged portion of the image-bearing member 10. This process records an electrostatic latent image which corresponds to the informational area contained within the original document. At development station C, one of at least two development housings 34 and 36 is brought into contact with the belt 10 for developing the latent image. The electrostatic latent image attracts the toner particles from the carrier beads, thereby forming toner powder images on the image-bearing member 10. If two colors of developer material are not required, the second developer housing may be omitted. If more colors are desired, additional development housings may be included.

The image-bearing member 10 then advances the developed latent image to transfer station D where a sheet of support material such as paper copy sheets is advanced into contact with the developed latent images on the belt 10. A corona generating device 46 charges the copy sheet to the proper potential so that it becomes tacked to the image-bearing member 10 and the toner powder image is attracted from the image-bearing member 10 to the sheet. After transfer, a corona generator 48 and optional charging device 46 charges the copy sheet to an opposite polarity to detach the copy sheet from belt 10.

After transfer, the sheet moves to fusing station E wherein the developed image is fused to the copy sheet as the sheet moves between fuser roller 72 and pressure roller 74.

Residual particles remaining on the image-bearing member 10 after each copy is made may be removed at cleaning station F or stored for disposal. The spots blade apparatus 230 is located downstream in the direction of movement of the image-bearing member from the cleaning station F.

As thus described, a reproduction machine in accordance with an embodiment of the present invention may be any of several well-known devices. Variations may be expected in specific electrophotographic processing such as CEP, paper handling and control arrangements without affecting the present invention. However, it is believed that the foregoing description is sufficient for purposes of the present application to illustrate the general operation of an electrophotographic printing machine, which A exemplifies one embodiment of the present invention therein.

Figure 2:
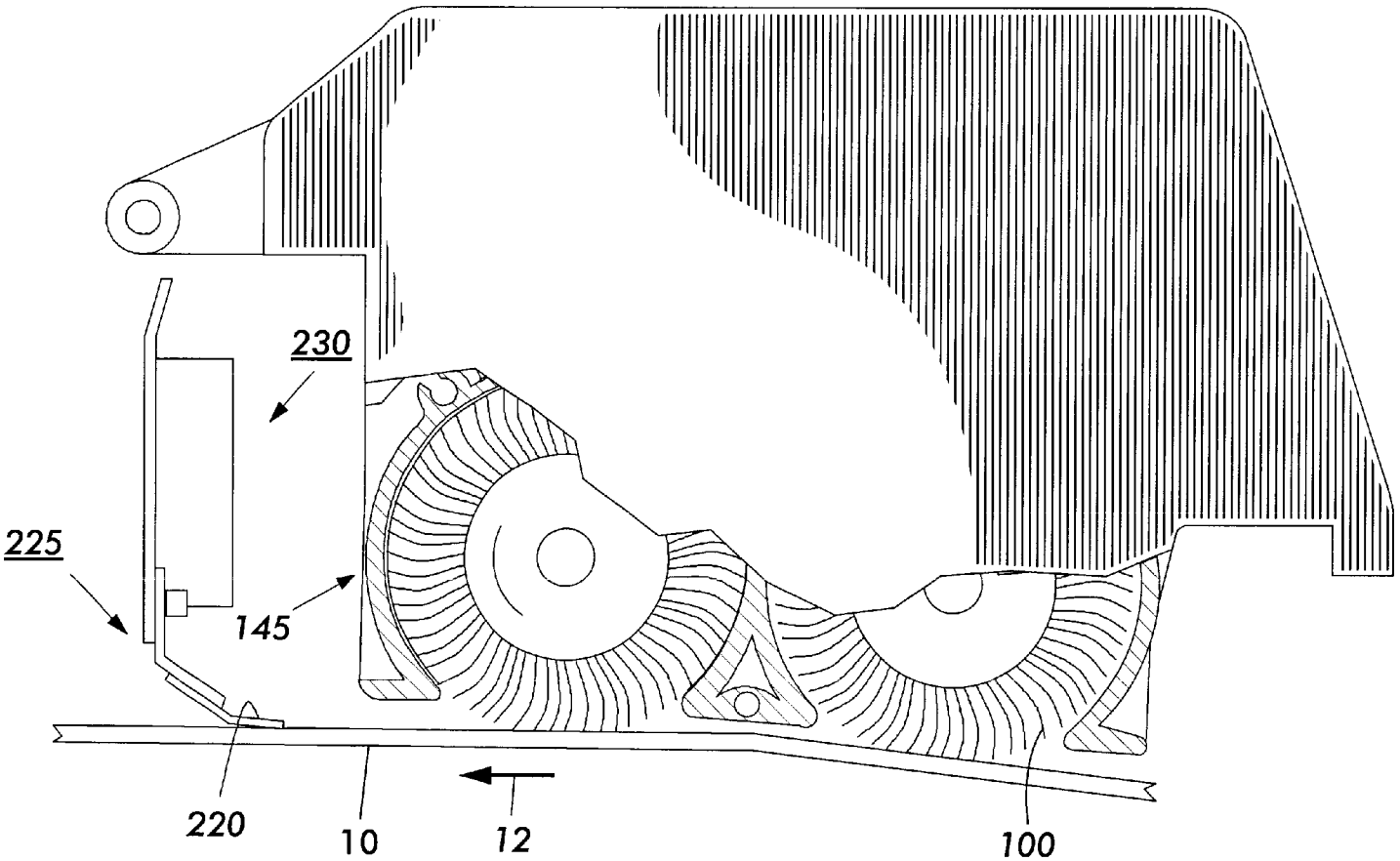
FIG. 2 PRIOR ART
FIG. 2 is a schematic view of a spots blade located downstream from the primary cleaner.

Reference is now made to FIG. 2, which shows a frontal elevational view of a cleaning system and a spots blade assembly 230. The spots blade assembly 230 comprises a holder 225 and a spots disturber blade 220. The spots blade assembly 230 is located downstream, in the direction of movement 12 of the image-bearing member 10, to disturb residual particles not removed by the primary cleaner brushes 100. This spots blade 220 is similar to that used in the Xerox 5090 copier. The spots blade 220 is normally in the doctoring mode to allow a build up of residual particles in front of the spots blade 220 (i.e. between the brush cleaner housing 145 and the spots blade 220). This build up of residual particles is removed by the air flow of the vacuum.

The cleaning blade comprises a "hard" material. As set forth in the background above, traditionally, a "soft" material having a hardness of from about 50 to about 83 Shore A was used as the cleaning blade material for cleaning residual particles in both dry toner and liquid toner systems. This is because only "soft" materials were known to possess the ability to tuck and conform to the imaging member in order to clean the imaging member, and return to their original shape when the blade force is released. "Hard" materials, alternatively, having a hardness of from about 84 to about 100 Shore A have been used as spots blades for cleaning agglomerate materials. These hard materials cannot tuck and conform to the imaging member. Because of the extreme hardness, inability to tuck, and nonconformity, the spots blade materials have been thought of as not suitable for use as a cleaning blade. This is especially true for urethane materials that are in the upper hardness range of 85 to 95 Shore A. In the lower hardness range from 80 to 90 Shore A, urethanes do not exhibit the low frictional properties of the harder urethanes in the range of 90 to 110 Shore A. The range of 80 to 90 Shore A is the transition range from "soft" to "hard" urethanes. In this range some urethanes will exhibit some tucking characteristics and high friction.

However, a "hard" blade material has been developed which includes, in embodiments, the superior characteristics of cleaning blades, such as the ability to clean without tucking, making the blade more resistant to tears and fractures. Blade conformability to a rigid surface (drum) or a flexible belt is achieved, in embodiments, by reducing the blade thickness by about 50 percent, increasing the blade extension out of the blade holder, and using a high resilient urethane. In addition, in embodiments, the blade has the ability to operate on an imaging surface without lubrication. This discovery greatly increases the reliability of cleaning blades, since the new hard cleaning blade, in embodiments, is tougher, lasts longer, and has a low coefficient of friction. Further advantages include the decrease or elimination, in embodiments, of blade chatter and blade squeal, and dispensing with the need to lubricate the blade with liquid or dry toner, or with other lubricant additives.

Figure 3:
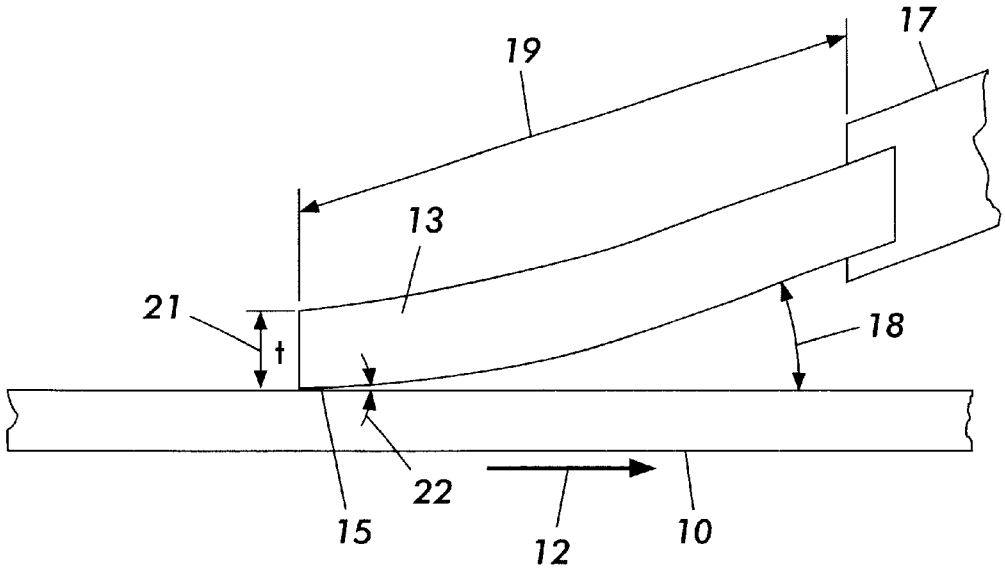
FIG. 3 is a schematic view of a cleaning blade in accordance with one embodiment of the present invention.

FIG. 3 demonstrates an embodiment of the present invention and includes a hard cleaning blade 13 in slidable contact with image-bearing member 10 moving in direction 12. Blade holder 17 holds blade 13 in position. Blade holder angle 18 is shown in FIG. 3 as the angle between the image member 10 and a bottom portion of blade 13 that represents the angle of the blade holder. Working angle 22 is depicted as the angle of the blade in the cleaning region. Blade tuck region 15 does not demonstrate any tuck or stick-slip friction in FIG. 3. FIG. 3 demonstrates a cleaning blade in accordance with one embodiment of the invention, wherein the thickness of the blade 21 is from about 45 to about 55 percent less, and preferably about 50 percent less than that of known "soft" cleaning blades. Blade 13 of an embodiment of the invention has a blade extension 19 longer than that of known cleaning blades.

The hard cleaning blade replaces the conventional "soft" cleaning blade used in printers and copiers, and may replace the assembly 145 including cleaning brushes 100 and may replace the spots blade 220. Furthermore, in a liquid ink system the hard cleaning blade replaces the soft cleaning blade and the foam roll agitator.

With the hard blade materials of embodiments of the present invention, the coefficient of friction is low, for example less than 10 for a clean blade sliding on a clean glass surface. When the blade friction is in this range, there is a decrease or elimination of the stick-slip friction. Therefore, the hard blade slides across an imaging member and does not stick to it. Accordingly, toner or other lubricants are not needed with the hard cleaning blade, in embodiments, as they are typically necessary for "soft" cleaning blades. In addition to the low frictional value, the hard blade materials have a much higher modulus, tensile strength toughness, and tensile stress values, in embodiments.

The hardness of the blade material of embodiments of the present invention, is greater than known "soft" cleaning blade materials which are usually about 70 SHORE A. The hardness is measured according to ASTM D2240 (5 plies). The hardness for the "hard" urethanes is from about 86 to about 120 Shore A, preferably from about 90 to about 110 Shore A, and particularly preferred from about 95 to about 105 Shore A. The hardness is a measure of the stiffness of the blade. A preferred Modulus for the blade materials of the present invention is from about 5,000 to about 30,000 psi, preferably from about 11,000 to about 19,000 psi.

The length or blade extension of the hard blade is preferably from about 6 to about 20 mm, and preferably from about 10 to about 15 mm, preferably when the blade thickness is about 1 mm. The blade bend or deflection depends on the thickness of the blade material and also the blade extension out of the blade holder.

The thickness 21 of the hard blade is preferably from about 0.5 to about 1.5 mm, and preferably from about 0.75 to about 1.25 mm.

The blade holder angle 18, or the angle formed between the blade holder and the image-bearing member 10, and positioned directly below the blade holder, is from about 15 to about 40 degrees, and preferably from about 25 to about 30 degrees.

The working angle 22 of the hard blade, or the angle formed by the portion of the blade bending upwards in the direction of the blade holder 17 and the image-bearing member 10, and directly in the blade tuck region, is from about 3 to about 30 degrees, and preferably from about 10 to about 25 degrees. The thickness and extension or length of the hard blade help to dictate the set up geometry.

All working materials must withstand tensile forces for good performance in their applications. The tensile stress of urethane materials is measured at different elongation. Tensile strength is the maximum tensile stress applied during elongating a specimen to rupture.

With high modulus urethanes, there are three useful cleaning properties. The blade material is "stiffer." This allows one to apply a larger contact pressure to the cleaning edge to enhance the cleaning in a stress condition. When the modulus is increased, the hardness increases and the friction of the urethane decreases. Thus modulus, hardness, and friction are interrelated. As shown in Table 1, the modulus for a "hard" urethane is about 10 times greater than the modulus for the "soft" urethane.

The coefficient of friction is a measure of the static and dynamic forces as materials are sheared against each other and can be measured by a variety of techniques. These forces are a function of material surface energy, normal force, molecular attachment, roughness and surface speed. A special fixture is used to measure the friction of the blade and the resistance of the urethane material to stress fractures and craters. This fixture consists of a slowly rotating glass cylinder and a blade sample holder. The glass cylinder is mounted on two metal end caps with a shaft. One shaft is attached to a torque transducer that measures the drag of the glass cylinder produced by the blade sample. The other shaft rotates freely in a bearing. A weight on the blade holder is used to apply a normal blade load of 25 gm/cm. This is a typical force used by "soft" urethane for cleaning. A smooth glass surface is used so that it can be cleaned thoroughly to eliminate the affects of dirt or other contaminates on the friction measurement. Glass always provides the same surface to test samples on. The only variable is the blade samples. The environment is always held at 30±5% RH (percent relative humidity), and 72±2° F. The coefficient of friction measured by this procedure for the hard blade materials in accordance with the present invention was determined to be less than 10, preferably less than 5, and particularly preferred from about 1 to about 3.

Turning to the blade holder, the blade sample is mounted or held in the blade holder that simulates a typical cleaning geometry for the cleaning edge. In addition, the blade sample has no extension out of the holder. This eliminates the bend in the blade and allows only the cleaning edge to be studied. The blade stress fractures created in this test fixture are the same as blade stress fractures created in a copier or printer. It is desired that the coefficient of friction for the cleaning blade be low so as to allow the blade to slide smoothly over the imaging surface in order to reduce or eliminate sticking, fold-over, or chattering of the blade against the imaging member. Although the actual measurements of the coefficient of friction may vary slightly depending on the method used for testing, the "hard" urethane cleaning blade material consistently demonstrates a low coefficient of friction and falls within the preferred range shown in Table 1. Further, methods for testing the coefficient of friction are well known to one of ordinary skill in the art.

The tensile stress of the hard blade is from about 1000 to about 4000, and preferably from about 1800 to about 3000 psi at 100% elongation. The tensile strength of the hard blade is from about 5000 to about 40,000, and preferably from about 10,000 to about 20,000 psi.

Further, methods for testing the coefficient of friction are well known to one of ordinary skill in the art.

Resiliency, the percent rebound, can be measured according to ASTM D2632. The resiliency of the cleaning blade is a measure of the blade's ability to conform to the imaging surface. This is a property that does not adversely affect cleaning until the resiliency is less than 15%. Then the conformability of the cleaning blade is reduced especially in cold/dry environments. Since cleaning is not sensitive to this material property, the preferred range is from about 20 to about 40 percent.

Toughness is the area under the stress/strain curve. This property is similar the tensile properties because the material must be able to undergo a large elongation or strain before rupture. For example, a material that exhibits high stress features, but ruptures with a small amount of strain is not an ideal urethane for cleaning toner or ink. In preferred embodiments, the "hard" urethane exhibits high toughness and elongation (strain) of from about 400 to about 500 percent before rupture. The combination of high toughness and low friction for "hard" urethanes makes them virtually impossible to produce stress fractures that would cause the blade to fail. The toughness values for "hard" urethanes are about 4 times greater than for "soft" urethanes.

The compression set is a measure of deformation that remains in the urethane after it has been subjected to and released from a specific compressive stress for a defined period of time at a prescribed temperature. This measurement is used in the rubber industry to evaluate the creep and stress relaxation properties of rubber. For a cleaning blade material, the creep and relaxation set properties are measured directly with a cleaning blade in a cleaning configuration. The relaxation set affects the blade load when the blade is loaded with a fixed interference. In this case, the relaxation set will cause the blade force to decrease with time. A high relaxation set value for the blade material will decrease the blade force below the minimum force required to remove toner or ink off the imaging surface or image carrier. The creep set measurement is determined for a blade that is loaded with a constant load such as with a gravity bar or a spring mechanism. A high creep set value will cause the cleaning blade working angle (WA) to change with time causing the blade to ride flat on the imaging surface and plane over the toner or the ink. Since the "hard" urethane creep and relaxation set values are larger than for "soft" urethanes, special attention has to be used to set the initial blade force and working angle. The starting cleaning set point depends on how the blade is going to be loaded. If the blade is loaded with a specified interference with respect to the imaging surface, then the initial force has to be high enough to compensate for the relaxation set that causes the blade force to decrease with time. If the blade is loaded with a constant load, the working angle needs to be set high enough to compensate for the creep set that cause the working angle to decrease with time.

The broad range for the creep and the relaxation set is from about 20 to about 50% and the preferred range is from about 20 to about 30%. This amount of set does not effect the cleaning when the set points are adjusted for this set change.

The physical properties for both "hard" and "soft" urethanes are compared in Table 1 below.

TABLE 1

Comparison of physical properties ranges for "hard" with average values for "soft" urethanes.

| Mechanical Properties | "Hard" urethane values | "Hard" urethane advantages over "soft" urethanes | Typical "Soft" urethane values |
|---|---|---|---|
| 1. Tensile Stress, at % elongation, psi | | Higher stress fracture resistance | |
| 100% | Broad: 1000–4000<br>Preferred: 1800–3000 | | 400–800 |
| 200% | Broad: 1500–6000<br>Preferred: 2500–4000 | | 700–1300 |
| 300% | Broad: 2000–10,000<br>Preferred: 3000–6000 | | 1400–3000 |
| 2. Tensile Strength, psi | Broad: 5000–40,000<br>Preferred: 10,000–20,000 | Higher stress fracture resistance | 3000–6000 |
| 3. Modulus, psi | Broad: 5000–30,000<br>Preferred: 10,000–20,000 | Eliminates blade tuck | 800–1500 |
| 4. Friction | Broad: less than 10<br>Preferred: less than 5 | No tuck, low friction, no stress fractures | 25–200 |

TABLE 1-continued

Comparison of physical properties ranges for "hard" with average values for "soft" urethanes.

| Mechanical Properties | "Hard" urethane values | "Hard" urethane advantages over "soft" urethanes | Typical "Soft" urethane values |
|---|---|---|---|
| 5. Resilience, % | Broad: 10–50<br>Preferred: 20–40 | Image-bearing member conformability | 8–50 |
| 6. Hardness (Durometer) Shore A | Broad: 86–120*<br>Preferred: 90–110<br>*Over 100 the hardness values are usually expressed in Shore D. | Low friction, no tuck, no stress fractures | 70 |
| 7. Toughness psi | Broad: 5000–20,000<br>Preferred: 10,000–15,000 | Higher stress fracture resistance | 2000–6000 |
| 8. Set Properties The set values are specified for one year. The approximate life of CRU. | Creep: Broad: 20–50%<br>Preferred: 20–30%<br>Relaxation: Broad: 20–50%<br>Preferred: 20–30% | Current "hard" urethanes do not have an advantage over "soft" urethanes. The "soft" urethane set properties currently are better than "hard" urethanes | Creep: 14%<br>Relaxation: 20% |

As mentioned above, the "hard" materials suitable for use as a cleaning blade have a much lower coefficient of friction than known "soft" blade materials. Soft materials have very high coefficient of frictions, for example, about 25 to 200. These measurements for coefficient of friction are measured using a clean glass surface and a clean blade sample at 30±5% RH and 72±2° F. The high friction for soft blades tended to cause a random failure mode for the soft cleaning blades, in that the blade was shown to tuck severely and stress the cleaning edge, thereby causing fractures in the blade. The stress fractures eventually developed into craters, and as the crater size increased, nicks developed along the cleaning edge. To reduce this random occurrence of severe tucking, the cleaning blade had to be lubricated continuously.

Figure 4:
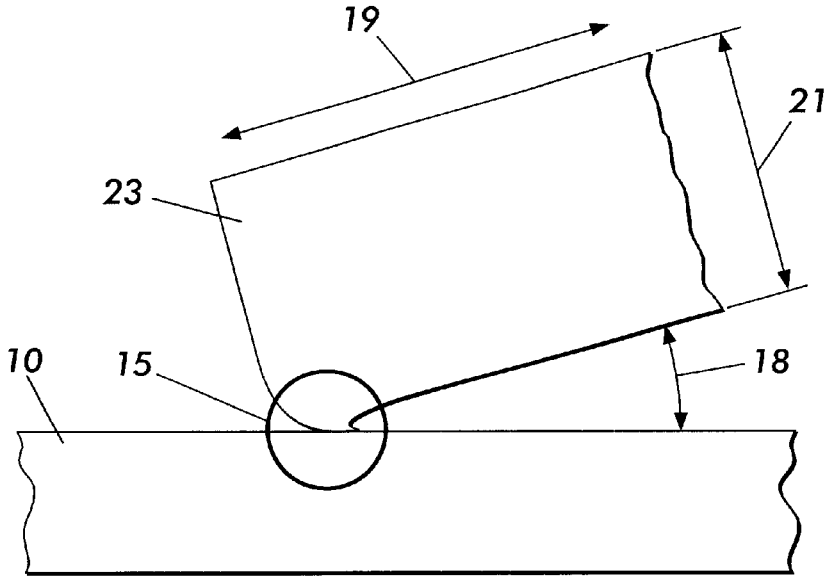
FIG. 4 is schematic view of a cleaning blade, and demonstrates the normal cleaning tuck for a "soft" urethane blade material.

FIG. 4 depicts an example of a soft urethane blade 23 undergoing tucking (area 15 in FIG. 4) against an imaging member 10. Soft urethanes clean effectively only when the cleaning edge is tucked uniformly as shown at area 15 in FIG. 4. As shown in FIG. 4, blade tuck and contact area are small. This causes contact pressure to be high, and seals the blade with the surface that is being cleaned. The soft urethanes are sticky, and have high adhesion to the surface being cleaned.

Figure 5:
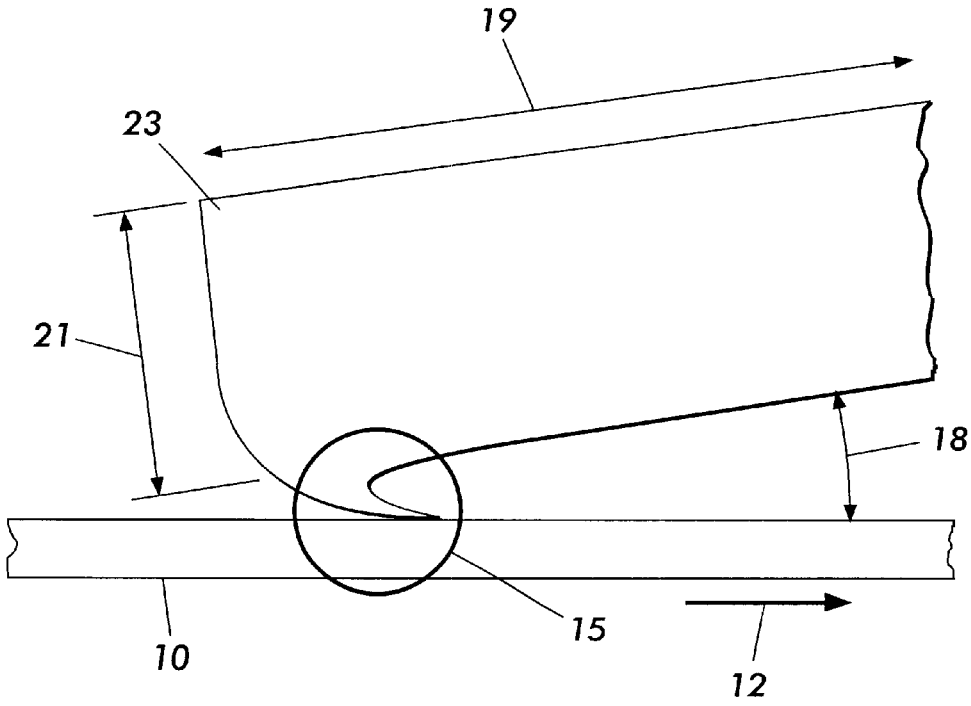
FIG. 5 is a schematic view of a cleaning blade, and demonstrates a large blade tuck for a "soft" urethane blade material.

FIG. 5 depicts an example of a soft urethane blade 23 undergoing stick-slip friction (area 15 in FIG. 5) against an imaging member 10. In FIG. 5, there is demonstrated an extreme tucked condition that occurs when the blade contacts a clean surface. When the internal forces of the urethane overcome the adhesion force, the elongated portion of the blade snaps back (slips) to its original position. Depending on the percent elongation, and the number of elongations, the blade develops a stress fracture. This is the beginning of blade failure. In FIG. 5, the soft blade 23 has a blade thickness 21 about 50 percent greater than that of hard blades in accordance with embodiments of the present invention. Moreover, the blade extension (blade length) 19 of the soft cleaning blade depicted in FIG. 5 is less than that of cleaning blades in accordance with preferred embodiments of the present invention.

Surprisingly, the cleaning blade in embodiments uses a material that possesses high hardness, high modulus, moderate resiliency and low friction. These blade properties1 enable the blade to clean without tucking and stressing the cleaning edge. The toughness of the blade increases service life and reliability. The low friction reduces abrasion to the imaging member, and also increases service life and reliability. The overall reliability allows the cleaning blade to be used in higher volume printers where more reliable cleaners are required. An additional advantage is that the blade cleaner with a "hard" urethane is now a low cost, high volume reliable cleaner. For example, it can replace a reliable electrostatic brush (ESB) cleaner, which costs about $200, with a $30 blade cleaner with equivalent reliability. Also, by use of the "hard" cleaning blade, one may dispense with the need for a cleaning apparatus such as blade or brush, in combination with a spots blade. Also, in a liquid ink system, the conventional foam roll agitator can be eliminated.

In a preferred embodiment, a polyuethane material is used as the cleaning blade material.

All the patents and applications referred to herein are hereby specifically and totally incorporated herein by reference in their entirety in the instant specification.

The following Examples further define and describe embodiments of the present invention. Unless otherwise indicated, all parts and percentages are by weight.

EXAMPLES

Example 1

"Hard" and "Soft" Cleaning Blade Comparison

The cleaning blade parameters are demonstrated in FIGS. 3, 4 and 5. For a "soft" urethane blade as depicted in FIGS. 4 and 5, the working angle 22 is about 10°, the blade holder angle 18 is about 22°, the blade extension 19 is about 10 mm, and the blade thickness 21 is about 2 mm. For a "hard" urethane blade as depicted in FIG. 3, the working angle 22 is about 10°, the blade holder angle 18 is about 28°, the blade extension 19 is about 12 mm, and the blade thickness 21 is about 1 mm. Thus, for a "hard" urethane blade in embodiments of the present invention, the blade holder angle is larger, the blade extension is longer, and the blade thickness is smaller than that of conventional, known soft urethane cleaning blades. The working angle is about the same.

Example 2

Figure 6:
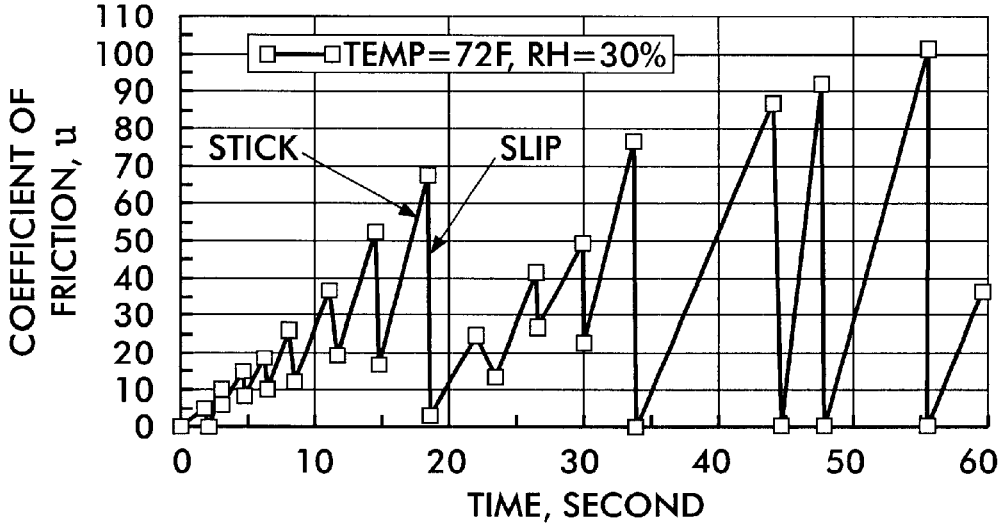
FIG. 6 is a graph of coefficient of friction versus time in seconds, and demonstrates the stick-slip friction for a "soft" urethane material.
Figure 7:
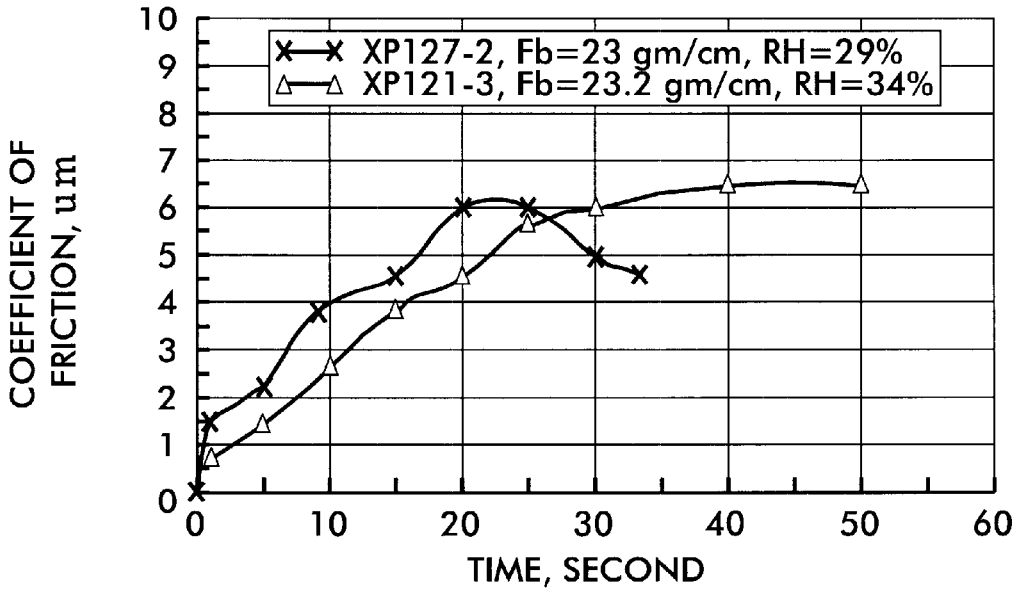
FIG. 7 is a graph of coefficient of friction versus time in seconds, and demonstrates the stick-slip friction for a "hard" urethane material.

Comparison of Coefficient of Friction for Both "Hard" and "Soft" Cleaning Blades The stick-slip friction for a "hard" urethane is shown in FIG. 7. The stick-slip friction for a "soft" urethane is shown in FIG. 6. The "hard" urethane blade materials that were studied in this Example were manufactured by ZATEC. FIGS. 6 and 7 demonstrate the coefficient of friction versus time in seconds. As shown in the graph of FIG. 7, the coefficient of friction for hard blades tested in this Example are lower than known soft cleaning blades (see FIG. 6). Further, the hard blades tested exhibited no stick-slip friction.

Example 3

Figure 8:
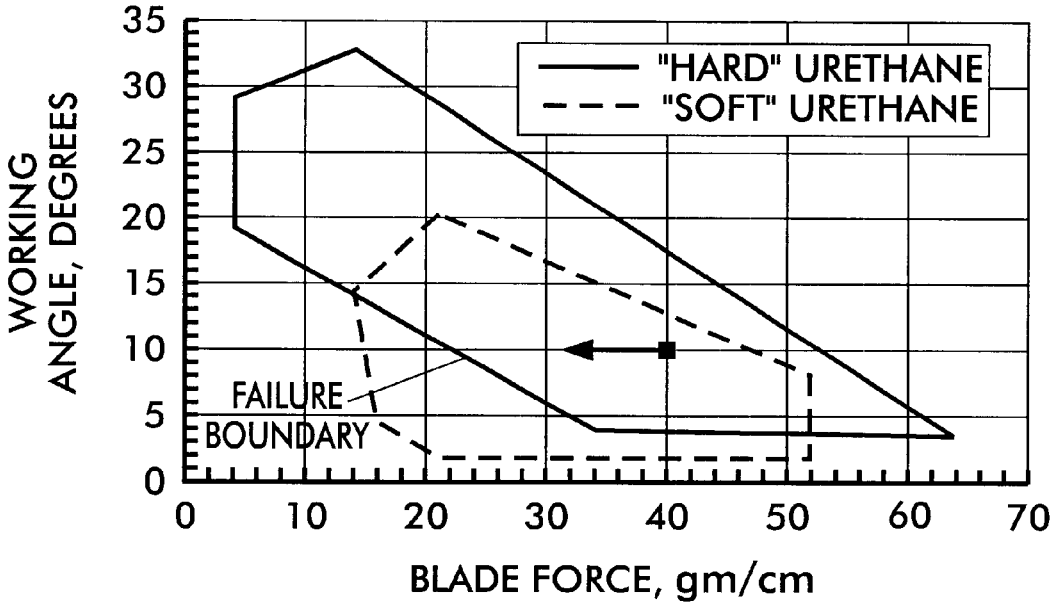
FIG. 8 is a graph of coefficient of friction versus time in seconds, and compares the operating space or latitude for "hard" and "soft" urethanes.

Comparison of "Hard" Blade Material Versus "Soft" Blade Material in Cleaning Residual Dry Toner Particles The "hard" urethane blade was placed in an Engineering printer that previously had experienced blade squeal problems because of low levels of lubrication during dead cycles between print jobs. With an embodiment of the "hard" urethane blade, the squeal problem disappeared, and toner cleaning was excellent. The latitude for a "soft" and a "hard" urethane is shown in FIG. 8. The latitude is defined in terms of the working angle (WA) versus the blade force. The results of the machine runs demonstrated that the latitude for the "hard" urethane was greater than for the "soft" urethane, and blade squeal was eliminated. The "hard" urethane latitude allows for a larger tolerance on the important parameters of blade thickness, extension, and interference. This reduces manufacturing costs and improves blade-cleaning reliability. An additional advantage of the "hard" urethane was that no form of extra lubrication was required to lubricate the blade to reduce blade squeal.

The square symbol located at WA=10° and 40 gm/cm was the initial starting set point for the blade. For a blade loaded with a fixed interference, the relaxation set caused the blade force to decrease by 21 percent or 8.4 gm/cm. The arrow depicts the decrease and the final force for blade (31.6 gm/cm) which is estimated to occur after one year. The blade force was still 10 gm/cm away from the low force failure boundary for the "hard" urethane. For a blade loaded with a constant force, the creep set caused the WA to decrease by 25 percent or 3.75°, or about 4°. For the same initial set point (WA=10°, and 40 gm/cm), the final WA after one year is estimated to be about 6°. This is close to the failure boundary. Therefore, for a blade loaded with a constant load, the initial set point for WA is preferably larger than WA=20°. This Example demonstrates how the initial set point is adjusted to compensate for relaxation and creep set. The larger latitude for a "hard" urethane allows for this.

Example 4

Comparison of "Hard" Blade Versus "Soft" Blade Cleaning of Liquid Toner

"Soft" urethane cleaner blades are used to remove liquid developer residual from image forming surfaces (companies that employ this are Savin, Ricoh, Indigo). Using a "soft" urethane material reduces the risk of damage to the image-forming surface, but increases the risk of blade failure through localized areas of high friction (blade sticking) and relatively low tensile strength. Blade failure occurs when blade sticking creates stress forces that exceed the tensile strength of the material causing stress fractures at the edge of the blade and eventually cleaning streaks.

Recent experiments have been conducted to characterize the performance of "hard" blade materials and the resulting blade tip drag using a liquid ink consisting of approximately 24 percent solids. When the blade is removing residual developer material, the blade is well lubricated. As the image is cleaned, the blade tip rides on a thin layer of residual carrier fluid. This thin layer is sufficient to lubricate the blade/image forming surface interface.

However, as this thin layer is removed, the blade contacts a 'dry' surface. 'Soft' urethanes have high coefficient of friction and will not slide on 'dry' surfaces without exhibiting stick-slip motion.

In laboratory studies a "hard" urethane was used to remove a 24 percent solids layer of ink (paste-like consistency). The blade material used in this test was an experimental material from ZATEC (XP127-2) with a hardness value of about 95 SHORE A. The blade geometry used to clean the ink was similar to the blade geometry one would use for toner. The amount of material removal was about 100 percent using a blade against a rotating glass cylinder "painted" with ink. After the ink was cleaned, the blade was allowed to ride on a thin layer of remaining carrier fluid.

With the "hard" urethane there was no measurable increase in friction and no stick-slip motion. When the 'soft' urethane was tried the blade cleaned the same 'pasty' ink well, and did not initially exhibit any increase in friction on the thin layer of liquid remaining on the surface. However, when the thin layer was not present, the blade would not slide on the surface and tucked immediately creating a severe stress fracture on the cleaning edge. As shown in this Example, the "soft" urethane does not function as an effective cleaner when the lubrication is low in a toner or ink system. However, "hard" urethane blade materials in accordance with embodiments of the present invention performed well with no measurable increase in friction and no stick-slip motion.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims. All references cited herein are hereby incorporated by reference in their entirety.

What is claimed is:

1. A cleaning apparatus not including a spots blade for cleaning materials from an imaging surface comprising:

a single type of cleaning member comprising a hard cleaning blade for cleaning residual particles from the imaging surface, said hard cleaning blade having an end being in pressure contact and in continuous slidable contact with said imaging surface, wherein said cleaning blade comprises a material having a hardness of from about 86 to about 120 Shore A.

2. The cleaning apparatus in accordance with claim 1, wherein said hardness is from about 90 to about 110 Shore A.

3. The cleaning apparatus in accordance with claim 2, wherein said hardness is from about 95 to about 105 Shore A.

4. The cleaning apparatus in accordance with claim 1, wherein said hard cleaning blade has a coefficient of friction of less than about 10.

5. The cleaning apparatus in accordance with claim 4, wherein said coefficient of friction is less than about 5.

6. The cleaning apparatus in accordance with claim 5, wherein said coefficient of friction is from about 1 to about 3.

7. The cleaning apparatus in accordance with claim 1, wherein said material is a urethane.

8. The cleaning apparatus in accordance with claim 7, wherein said urethane is a polyurethane.

9. The cleaning apparatus in accordance with claim 1, wherein said hard cleaning blade has a length of from about 6 to about 20 mm.

10. The cleaning apparatus in accordance with claim 9, wherein said hard cleaning blade has a length of from about 10 to about 15 mm.

11. The cleaning apparatus in accordance with claim 1, wherein said hard cleaning blade has a thickness of from about 0.5 to about 1.5 mm.

12. The cleaning apparatus in accordance with claim 11, wherein said hard cleaning blade has a thickness of from about 0.75 to about 1.25 mm.

13. A cleaning apparatus in accordance with claim 1, wherein said hard cleaning blade is non-tucking while in pressure contact with said imaging surface.

14. A cleaning apparatus in accordance with claim 1, wherein said hard cleaning blade exhibits a decrease in stick-slip motion while in pressure contact with said imaging surface.

15. A cleaning apparatus not including a spots blade for cleaning materials from an imaging surface comprising:

a single type of cleaning member comprising a hard cleaning blade for cleaning residual particles from the imaging surface, said hard cleaning blade having an end being in pressure contact and in continuous slidable contact with said imaging surface, wherein said cleaning blade comprises polyurethane having a hardness of from about 94 to about 95 Shore A, and a coefficient of friction of less than about 10.

16. An image forming apparatus not including a spots blade for forming images on a recording medium comprising:

a) a charge-retentive surface to receive an electrostatic latent image thereon;

b) a development component to apply toner to said charge-retentive surface to develop said electrostatic latent image to form a developed image on said charge retentive surface;

c) a transfer component to transfer the developed image from said charge retentive surface to a copy substrate; and d) a cleaning apparatus for cleaning materials from an imaging surface comprising:

a single type of cleaning member comprising a hard cleaning blade for cleaning residual particles from the imaging surface, said hard cleaning blade having an end being in pressure contact and in continuous slidable contact with said imaging surface, wherein said cleaning blade comprises a material having a hardness of from about 86 to about 120 Shore A.

17. The image forming apparatus in accordance with claim 16, wherein said hardness is from about 90 to about 110 Shore A.

18. The image forming apparatus in accordance with claim 16, wherein said hard cleaning blade has a coefficient of friction of less than about 10.

19. The image forming apparatus in accordance with claim 18, wherein said coefficient of friction is less than about 5.

20. The image forming apparatus in accordance with claim 19, wherein said coefficient of friction is from about 1 to about 3.

21. The image forming apparatus in accordance with claim 16, wherein said hard cleaning blade is non-tucking while in pressure contact with said imaging surface.

22. The image forming apparatus in accordance with claim 16, wherein said hard cleaning blade exhibits a decrease in stick-slip motion while in pressure contact with said imaging surface.

23. The image forming apparatus in accordance with claim 16, wherein said residual particles comprise dry toner.

24. The image forming apparatus in accordance with claim 16, wherein said residual particles comprise liquid toner.

* * * * *